US008910923B2

(12) United States Patent
Moll et al.

(10) Patent No.: US 8,910,923 B2
(45) Date of Patent: Dec. 16, 2014

(54) CHAIN HOIST HAVING A SLIP CLUTCH

(75) Inventors: Oliver Moll, Solingen (DE); Rene Schlieker, Wetter (DE)

(73) Assignee: Terex MHPS GmbH, Düsseldorf (DE)

( * ) Notice: Subject to any disclaimer, the term of this patent is extended or adjusted under 35 U.S.C. 154(b) by 322 days.

(21) Appl. No.: 13/509,414

(22) PCT Filed: Nov. 8, 2010

(86) PCT No.: PCT/EP2010/066995

§ 371 (c)(1),
(2), (4) Date: May 11, 2012

(87) PCT Pub. No.: WO2011/061083

PCT Pub. Date: May 26, 2011

(65) Prior Publication Data

US 2012/0234643 A1 Sep. 20, 2012

(30) Foreign Application Priority Data

Nov. 17, 2009 (DE) ..... 10 2009 053 613

(51) Int. Cl.
*B66D 1/14* (2006.01)
*B66D 3/20* (2006.01)

(52) U.S. Cl.
CPC ..... *B66D 3/20* (2013.01)
USPC ..... 254/365; 254/370

(58) Field of Classification Search
USPC ..... 254/301, 309, 317, 346, 348, 355, 365, 254/370
See application file for complete search history.

(56) References Cited

U.S. PATENT DOCUMENTS

| | | | | |
|---|---|---|---|---|
| 2,175,382 | A | 10/1939 | Eason | |
| 2,348,382 | A * | 5/1944 | Halby | 254/355 |
| 2,349,494 | A * | 5/1944 | Fawick | 188/367 |
| 2,525,402 | A * | 10/1950 | Dehn | 254/362 |
| 3,319,751 | A | 5/1967 | Sacchini | |
| 3,396,557 | A | 8/1968 | Moores, Jr. | |
| 6,966,545 | B2 | 11/2005 | Eising et al. | |

FOREIGN PATENT DOCUMENTS

| | | |
|---|---|---|
| CN | 201180750 Y | 1/2009 |
| DE | 354283 | 6/1922 |
| DE | 699344 | 11/1940 |
| DE | 10244865 A1 | 4/2004 |
| DE | 102006001154 B4 | 7/2007 |
| KR | 100803260 B1 | 2/2008 |

OTHER PUBLICATIONS

English Translation of the International Preliminary Report on Patentability from the International Bureau for corresponding International Application No. PCT/EP2010/066995 issued Jun. 12, 2012.

(Continued)

*Primary Examiner* — Emmanuel M Marcelo
(74) *Attorney, Agent, or Firm* — Gardner, Linn, Burkhart & Flory, LLP

(57) ABSTRACT

A chain hoist having an electric drive motor connected to a gearbox by a slip clutch, wherein the slip clutch comprises an enlarged outer surface area in the form of recesses disposed in the outer surface of the slip clutch for improving heat dissipation with the recesses being implemented circumferentially in the form of a thread pitch in the outer surface of the slip clutch.

20 Claims, 2 Drawing Sheets

(56) References Cited

OTHER PUBLICATIONS

International Search Report from corresponding Patent Cooperation Treaty (PCT) Application No. PCT/EP2010/066995.

Written Opinion from corresponding Patent Cooperation Treaty (PCT) Application No. PCT/EP2010/066995.

* cited by examiner

CHAIN HOIST HAVING A SLIP CLUTCH

CROSS REFERENCE TO RELATED APPLICATION

The present application claims the priority benefits of International Patent Application No. PCT/EP2010/066995, filed on Nov. 8, 2010, and also of German Patent Application No. DE 10 2009 053 613.2, filed on Nov. 17, 2009, which are hereby incorporated herein by reference in their entireties.

BACKGROUND OF THE INVENTION

The invention relates to a chain hoist having an electric drive motor which is connected to a gearbox by means of a slip clutch.

German patent DE 102 44 865 B4 already discloses a chain hoist having an electric drive motor which, by means of a gearbox connected downstream of the drive motor, drives a chain wheel for a chain for lifting and lowering a load. In order to avoid gearbox or drive motor overload e.g. when the chain is hooked onto the no-load side, a slip clutch is disposed between the drive motor and the gearbox. The slip clutch consists of a first annular clutch element and a second annular clutch element which are in engagement via a friction lining. The first clutch element is disposed concentrically on a driven-side end of a motor shaft of the drive motor and is connected in a rotationally fixed manner to the motor shaft. The second clutch element is disposed in a comparable manner on a first end of a gearbox input shaft of the gearbox. In order to be able to adjust the activation force of the slip clutch, the gearbox input shaft is disposed in an axially displaceable manner and the gearbox input shaft together with the second clutch element is pretensioned in the direction of the first clutch element by means of a spring element.

Furthermore, U.S. Pat. No. 3,396,557 A discloses a hammer drill which is driven by means of an electric motor. The electric motor is connected to receiver for a drilling tool by means of a gearbox. Disposed inside the gearbox is a slip clutch to be activated in the event of a pre-settable torque which acts upon the drilling tool. The slip clutch comprises a cylindrical housing which on its outer side comprises radially circumferential and outwardly directed fins. These fins should allow rapid dissipation of heat from the housing.

SUMMARY OF THE INVENTION

The object of the invention is to provide a chain hoist which comprises an improved slip clutch.

The object is achieved by a chain hoist in accordance with the present invention.

In accordance with an embodiment of the invention, in the case of a chain hoist having an electric drive motor which is connected to a gearbox by means of a slip clutch, wherein in order to improve the dissipation of heat the slip clutch has an enlarged outer surface in the form of recesses disposed in the outer surface of the slip clutch, the slip clutch thereof is improved by virtue of the fact that the recesses are formed circumferentially in the form of a thread pitch in the outer surface of the slip clutch. In this way, continuous slip tests which are required in accordance with applicable standards can be fulfilled. By virtue of the enlarged outer surface, adequate dissipation of heat can be achieved, without substantially increasing the installation size of the clutch. As a result, it is possible to achieve an increase in the size of the heat exchange surface using simple means. Improved dissipation of heat is also achieved by the conveying effect of the thread pitch.

In constructional terms, provision is made in a particular embodiment that the slip clutch consists of a sleeve-shaped first clutch element having a first annular clutch surface and of a sleeve-shaped second clutch element having a second annular clutch surface, and a friction lining is disposed between the first clutch surface and the second clutch surface.

As a further constructional detail, it is provided that the first clutch element consists of a sleeve-shaped first attachment part and of a sleeve-shaped first clutch disk part adjoining it, the second clutch element consists of a sleeve-shaped second attachment part and of a sleeve-shaped second clutch disk part adjoining it, and the outer surface for increasing the dissipation of heat is disposed in the region of the peripheral surface of the first clutch disk part. In this case, when the gearbox is blocked and the slip clutch effects a response the first clutch disk part continues to be rotated by the drive motor and gearbox oil thus continues to be conveyed from the thread-like recesses into the bore and further cooling is thus effected.

In this case, the second attachment part is advantageously inserted into the clutch element.

It is particularly space-saving that the slip clutch is disposed in bore of a housing of the gearbox.

In a particular constructional embodiment, the housing has a gearbox chamber disposed inside it which is connected to the bore and is filled with a gearbox oil.

In order to improve cooling and to convey the gearbox oil, a gap is disposed between the cylindrical outer surface of the slip clutch and the inner surface of the bore.

An exemplified embodiment of the invention is described with reference to the accompanying drawings.

DESCRIPTION OF THE PREFERRED EMBODIMENTS

Figure 1:
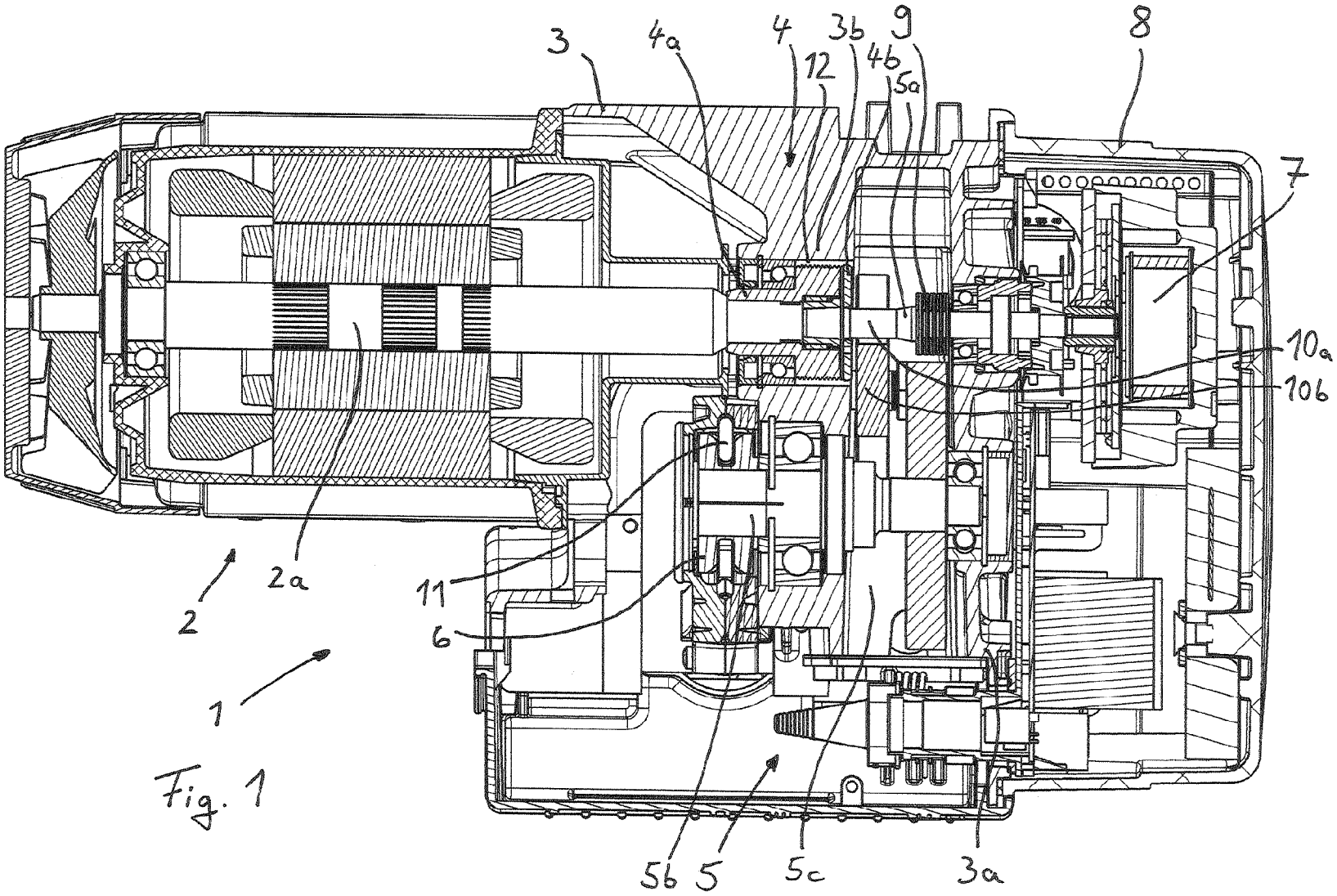
FIG. 1 shows a sectional view of a chain hoist in accordance with the invention.

FIG. 1 illustrates a sectional view of a chain hoist 1 in accordance with an embodiment of the invention. The chain hoist 1 is driven by an electric drive motor 2 which is attached by its driven-side end to a housing 3 of the chain hoist 1. A slip clutch 4, a gearbox 5 and a chain wheel 6 are accommodated in the housing 3. The drive motor 2 comprises a motor shaft 2*a* whose driven-side end is connected to the gearbox 5 by means of the slip clutch 4. The slip clutch 4 consists substantially of a first clutch element 4*a* and a second clutch element 4*b* which are in engagement with one another by means of a friction lining 4*c* (see FIG. 2). The first clutch element 4*a* is disposed concentrically with respect to the motor shaft 2*a* and in a rotationally fixed manner on its driven-side end. The second clutch element 4*b* is disposed concentrically with respect to a gearbox input shaft 5*a* and in a rotationally fixed manner on its first end. In this case, the motor shaft 2*a* and the gearbox input shaft 5*a* are disposed—as seen in the longitudinal direction thereof—one behind the other and concentrically with respect to each other. At the opposite second end, the gearbox input shaft 5*a* is mounted in an outer wall 3*a* of the housing 3. This second end is engaged by an electrically releasable brake 7 which is supported externally on the outer wall 3*a*. The brake 7 is disposed under a cover 8 which is attached to the outer side of the outer wall 3*a*. The cover 8 provides sufficient space to accommodate electrical and/or electronic components in a protected manner.

In order to be able to adjust the slip clutch 4 and to be able to pretension the second clutch element 4*b* in the direction of the first clutch element 4*a*, on the one hand the gearbox input shaft 5*a* is mounted so as to be displaceable in its axial direction and on the other hand is supported on the inner side of the outer wall 3*a* by means of a spring element 9. Furthermore, the gearbox input shaft 5*a* is formed as a pinion shaft having a first gear wheel 10*a* which meshes with a second gear wheel 10*b* of the gearbox 3. The two gear wheels 10*a*, 10*b* thus form the first gear stage.

In the illustrated embodiment the first gear wheel 10*a* of the gearbox input shaft 5*a* is formed with an oblique toothing arrangement such that during operation of the chain hoist 1 the axial force effected by the oblique toothing arrangement in the longitudinal direction of the gearbox input shaft 5*a* leads to an increase in the frictional force of the slip clutch 4 during the lifting operation. This makes it possible to effect an automatic change in the activation moment, without changing the setting of the activation moment of the slip clutch 4, during operation of the chain hoist 1 as opposed to when the chain hoist 1 is at a standstill. This is associated with the advantage that when the direction of the flow of force is reversed in the gearbox 5 by hooking the chain onto the no-load side the axial force of the toothing arrangement counteracts the pretensioning of the spring element 9 and the torque which activates the slip clutch 4 is reduced. This reduces the risk of damage to the chain hoist 1.

Furthermore, the gearbox 5 comprises a gearbox output shaft 5*b* which extends in parallel with the gearbox input shaft 5*a* and is mounted laterally thereto in an offset manner in the housing 3. On the driven-side, the chain wheel 6 is disposed on the gearbox output shaft 5*b* in a rotationally fixed manner and concentrically with respect thereto, wherein a chain 11 of the chain hoist 1 can be moved in the lifting and lowering direction by means of the chain wheel. The gearbox input shaft 5*a* and the gearbox output shaft 5*b* are disposed in a gearbox chamber 5*c* which is defined by the housing 3. The gearbox chamber 5*c* is typically filled with a gearbox oil.

The chain hoist 1 can be suspended at a desired location by means of an eyelet, not illustrated, which engages the housing 3 externally and at the top.

Figure 2:
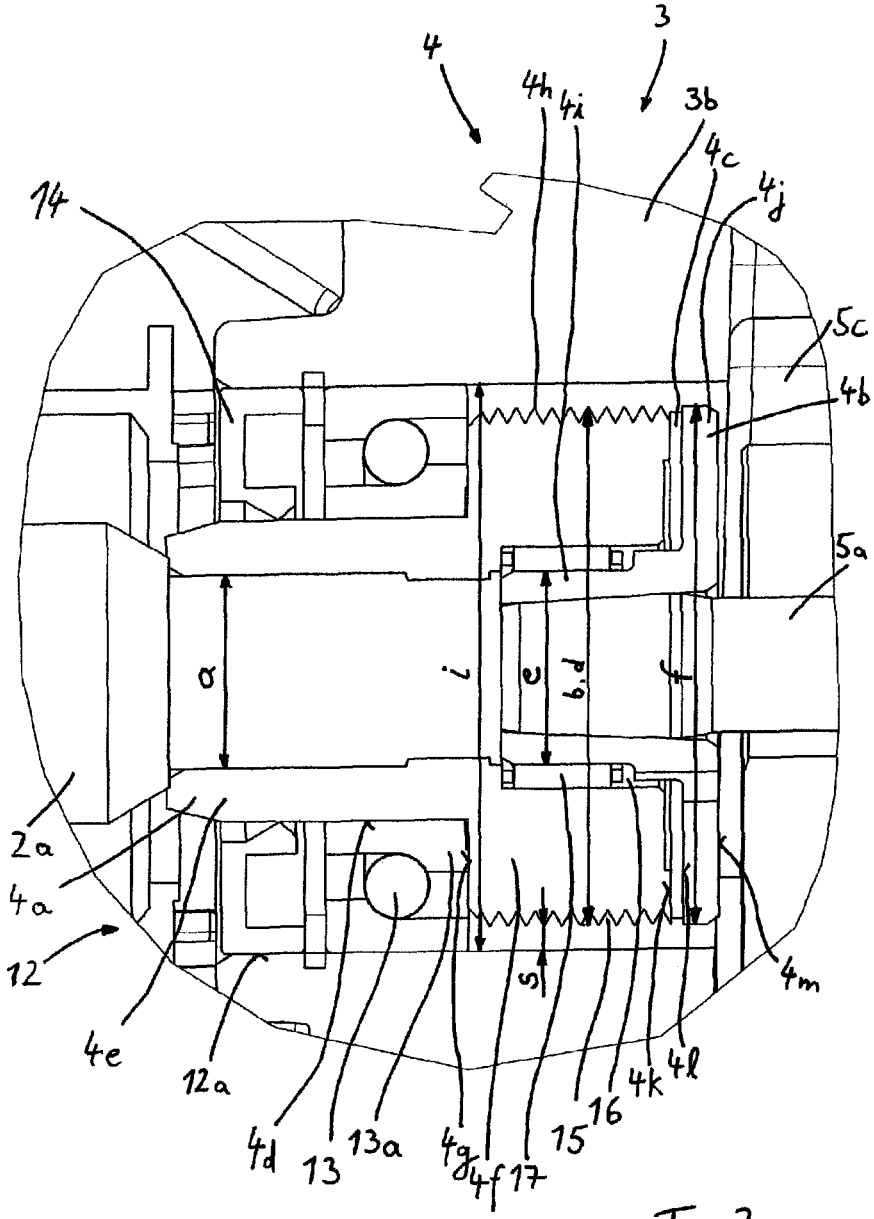
FIG. 2 shows an enlargement of a section of FIG. 1 from the region of a slip clutch of the chain hoist.

FIG. 2 illustrates an enlargement of a section of FIG. 1 from the region of the slip clutch 4 of the chain hoist 1. It is apparent that the slip clutch 4 is disposed in a bore 12 in an intermediate wall 3*b* of the housing 3. The bore 12 has a circular cross-section with an inner surface 12*a* and inner diameter i which is slightly larger than the outer diameter d of the slip clutch 4. The slip clutch 4 is substantially cylindrical with a stepped outer surface 4*d*. Between the inner surface 12*a* of the bore 12 and the outer surface 4*d* of the slip clutch 4 there is a gap s which extends around the slip clutch 4 and is approximately in the range of 1 mm to 5 mm. In this case, the bore 12 extends with its bore wall 12*b* starting from the intermediate wall 3*b* in the direction of the drive motor 2 and the bore wall 12*b* forms a type of projection on the intermediate wall 3*b*.

The slip clutch 4 consists substantially of the first clutch element 4*a* and the second clutch element 4*b*. The first clutch element 4*a* attached to the motor shaft 2*a* is essentially in the shape of a sleeve which has a flange projection and can be divided into a first attachment part 4*e* and a flange-like first clutch disk part 4*f*. The attachment part 4*e* and the clutch disk part 4*f* differ substantially by virtue of their mutually different outer diameters a, b. The outer diameter a of the attachment part 4*e* changes suddenly into the outer diameter b of the clutch disk part 4*f*. As a consequence, the clutch disk part 4*f* has an annular bearing surface 4*g* formed thereon, against which lies the inner ring 13*a* of a ball bearing 13, by means of which the attachment part 4*e* and thus the motor shaft 2*a* inserted therein are supported on the inner surface 12*a* of the bore 12. Adjacent to the ball bearing 13 as seen in the direction of the drive motor 2, a sealing ring 14 is placed onto the attachment part 4*e* and is supported externally on the inner surface 12 of the bore 12 and therefore seals the attachment part 4*e* in the bore 12 and thus the gearbox chamber 5*c*.

It is also apparent from FIG. 2 that the clutch disk part 4*f* of the clutch 4 comprises a circumferential peripheral surface 4*h* which is not formed in a planar manner but instead has recesses 15. The recesses 15 have the function of enlarging the peripheral surface 4*h* and thus improving the dissipation of heat from the clutch 4 into the gearbox oil. These recesses 15 are formed as circumferential thread pitches, wherein the mobility of the thread pitches is selected such that during the lifting operation of the chain hoist 1 gearbox oil is conveyed by the thread pitches into the bore 12. During the lowering operation, conveyance also takes place, since the thread pitches convey the gearbox oil out of the bore 12 and therefore fresh gearbox oil flows subsequently from the gearbox chamber 5*c*. Moreover, the clutch disk part 4*f* is over-dimensioned in relation to the required mechanical strength, in order to improve the absorption of the frictional heat of the clutch 4 on account of the mass present as a result. By reason of the improvement in cooling, the first clutch disk part 4*f* can be disposed completely in the bore 12.

It is also possible to vary the shape and pitch of the thread pitches. It is also feasible to use multi-pitch threads or grooves which are aligned in the longitudinal direction of the motor shaft, in order to create a type of bucket wheel effect.

In contrast to the first clutch element 4*a*, the requirements for sufficient cooling of the second clutch element 4*b* can be met more easily, since the second clutch element 4*b* is disposed at an end of the bore 12 facing the gearbox chamber 5*c* and therefore can deliver the frictional heat easily to the gearbox oil. The second clutch element 4*b* is basically of the same design as the first clutch element 4*a*, wherein the recesses 15 and the over-dimensioning are not required. Accordingly, the second clutch element 4*b* is in the shape of a sleeve which has a flange projection and can be divided into a second attachment part 4*i* and a flange-like second clutch disk part 4*j*. The second attachment part 4*i* and the second clutch disk part 4*j* differ substantially by virtue of their mutually different outer diameters e, f. The outer diameter e of the attachment part 4*i* changes suddenly into the outer diameter f of the clutch disk part 4*j*. This creates on the second clutch disk part 4*j* an annular second clutch surface 4*l*, to which the annular friction lining 4*c* is adhered. The friction lining 4*c* lies with its opposite friction surface against the first clutch surface 4*k* of the second clutch disk part 4*j*. The first annular clutch surface 4*k* is disposed in parallel with the bearing surface 4*g* of the first clutch disk part 4*f* and lies against the side of the first clutch disk part 4*f* opposite the bearing surface 4*g*.

Furthermore, the second clutch disk part 4*j* comprises an annular surface 4*m* which is in parallel with and opposite to the second clutch surface 4*l*, is disposed at the end of the bore 12 and faces the gearbox chamber 5*c*. Accordingly, the second clutch element 4*b* can be cooled effectively via its annular surface 4*m*.

FIG. 2 also shows that the second clutch element 4*b* is inserted with its second attachment part 4*i* into a clutch bore 16 in the interior of the first clutch disk part 4*f* and is mounted via a needle bearing 17. Accordingly, the outer diameter e of the second attachment part 4*i* is smaller than the inner diameter of the clutch bore 16. As a consequence, the friction lining 4*c* can come to lie against the first clutch surface 4*k* of the first clutch element 4*a*.

LIST OF REFERENCE NUMERALS 1 chain hoist
2 drive motor
2*a* motor shaft
3 housing
3*a* outer wall
3*b* intermediate wall
4 slip clutch
4*a* first clutch element
4*b* second clutch element
4*c* friction lining
4*d* outer surface
4*e* first attachment part
4*f* first clutch disk part
4*g* bearing surface
4*h* peripheral surface
4*i* second attachment part
4*j* second clutch disk part
4*k* first clutch surface
4*l* second clutch surface
4*m* annular surface
5 gearbox
5*a* gearbox input shaft
5*b* gearbox output shaft
5*c* gearbox chamber
6 chain wheel
7 brake
8 cover
9 spring element
10*a* first gear wheel
10*b* second gear wheel
11 chain
12 bore
12*a* inner surface of the bore 12
13 ball bearing
13*a* inner ring of the ball bearing 13
14 sealing ring
15 recesses
16 clutch bore
17 needle bearing
a outer diameter of the first attachment part 4*e*
b outer diameter of the first clutch disk part 4*f*
d outer diameter of the clutch 4
e outer diameter of the second attachment part 4*i*
f outer diameter of the second clutch disk part 4*j*
i inner diameter of the bore 12
s gap

The invention claimed is:

1. Chain hoist having an electric drive motor which is connected to a gearbox by a slip clutch, wherein in order to improve the dissipation of heat the slip clutch has an enlarged outer surface in the form of recesses disposed in the outer surface of the slip clutch, wherein the recesses in the outer surface of the slip clutch are formed circumferentially in the form of a thread pitch.

2. Chain hoist as claimed in claim 1, wherein the slip clutch comprises a sleeve-shaped first clutch element having a first annular clutch surface and a sleeve-shaped second clutch element having a second annular clutch surface, and a friction lining is disposed between the first clutch surface and the second clutch surface.

3. Chain hoist as claimed in claim 2, wherein the first clutch element comprises a sleeve-shaped first attachment part and a sleeve-shaped first clutch disk part adjoining it, the second clutch element comprises a sleeve-shaped second attachment part and a sleeve-shaped second clutch disk part adjoining it, and in order to improve the dissipation of heat the outer surface is disposed in the region of the peripheral surface of the first clutch disk part.

4. Chain hoist as claimed in claim 2, wherein the slip clutch is disposed in a bore of a housing of the gearbox.

5. Chain hoist as claimed in claim 4, wherein the outer surface of the slip clutch is cylindrical and wherein a gap is disposed between the cylindrical outer surface of the slip clutch and an inner surface of the bore.

6. Chain hoist as claimed in claim 4, wherein the housing has a gearbox chamber disposed inside it which is connected to the bore and is filled with a gearbox oil.

7. Chain hoist as claimed in claim 6, wherein the outer surface of the slip clutch is cylindrical and wherein a gap is disposed between the cylindrical outer surface of the slip clutch and an inner surface of the bore.

8. Chain hoist as claimed in claim 3, wherein the second attachment part is inserted into the first clutch element.

9. Chain hoist as claimed in claim 8, wherein the slip clutch is disposed in a bore of a housing of the gearbox.

10. Chain hoist as claimed in claim 9, wherein the housing has a gearbox chamber disposed inside it which is connected to the bore and is filled with a gearbox oil.

11. Chain hoist as claimed in claim 10, wherein the outer surface of the slip clutch is cylindrical and wherein a gap is disposed between the cylindrical outer surface of the slip clutch and an inner surface of the bore.

12. Chain hoist as claimed in claim 9, wherein the outer surface of the slip clutch is cylindrical and wherein a gap is disposed between the cylindrical outer surface of the slip clutch and an inner surface of the bore.

13. Chain hoist as claimed in claim 3, wherein the slip clutch is disposed in a bore of a housing of the gearbox.

14. Chain hoist as claimed in claim 13, wherein the housing has a gearbox chamber disposed inside it which is connected to the bore and is filled with a gearbox oil.

15. Chain hoist as claimed in claim 13, wherein the outer surface of the slip clutch is cylindrical and wherein a gap is disposed between the cylindrical outer surface of the slip clutch and an inner surface of the bore.

16. Chain hoist as claimed in claim 14, wherein the outer surface of the slip clutch is cylindrical and wherein a gap is disposed between the cylindrical outer surface of the slip clutch and an inner surface of the bore.

17. Chain hoist as claimed in claim 1, wherein the slip clutch is disposed in a bore of a housing of the gearbox.

18. Chain hoist as claimed in claim 17, wherein the housing has a gearbox chamber disposed inside it which is connected to the bore and is filled with a gearbox oil.

19. Chain hoist as claimed in claim 17, wherein the outer surface of the slip clutch is cylindrical and wherein a gap is disposed between the cylindrical outer surface of the slip clutch and an inner surface of the bore.

20. Chain hoist as claimed in claim 18, wherein the outer surface of the slip clutch is cylindrical and wherein a gap is disposed between the cylindrical outer surface of the slip clutch and an inner surface of the bore.

* * * * *